US010843147B2

(12) United States Patent
Kong et al.

(10) Patent No.: US 10,843,147 B2
(45) Date of Patent: Nov. 24, 2020

(54) METHOD AND APPARATUS FOR RAPID MIXING OF HIGHLY VISCOUS FLUIDS

(71) Applicant: VERSITECH LIMITED, Hong Kong (CN)

(72) Inventors: Tiantian Kong, Hong Kong (CN); Zhou Liu, Hong Kong (CN); Ho Cheung Shum, Hong Kong (CN); Liqiu Wang, Hong Kong (CN)

(73) Assignee: VERSITECH LIMITED, Hong Kong (CN)

( * ) Notice: Subject to any disclaimer, the term of this patent is extended or adjusted under 35 U.S.C. 154(b) by 0 days.

(21) Appl. No.: 15/575,750

(22) PCT Filed: May 29, 2015

(86) PCT No.: PCT/CN2015/080313
§ 371 (c)(1),
(2) Date: Nov. 20, 2017

(87) PCT Pub. No.: WO2016/191949
PCT Pub. Date: Dec. 8, 2016

(65) Prior Publication Data

US 2018/0111100 A1 Apr. 26, 2018

(51) Int. Cl.
*B01F 13/00* (2006.01)
*B01F 3/10* (2006.01)

(52) U.S. Cl.
CPC ..... *B01F 13/0003* (2013.01); *B01F 3/10* (2013.01); *B01F 2215/045* (2013.01);
(Continued)

(58) Field of Classification Search
CPC ..... B01F 2215/0427; B01F 2215/045; B01F 3/0003; B01F 13/0003; B01F 3/10;
(Continued)

(56) References Cited

U.S. PATENT DOCUMENTS 5,762,775 A * 6/1998 DePaoli ..... B01F 3/04978 204/554
2003/0086333 A1* 5/2003 Tsouris ..... B01F 13/0076 366/173.1
2004/0231990 A1 11/2004 Aubry et al.

FOREIGN PATENT DOCUMENTS

CA 2766795 A1 12/2010
TW 200948467 A 12/2009
(Continued)

OTHER PUBLICATIONS

International Preliminary Report on Patentability in corresponding PCT Application No. PCT/CN2015/080313, dated Mar. 3, 2016.
(Continued)

*Primary Examiner* — Anshu Bhatia
(74) *Attorney, Agent, or Firm* — Leason Ellis LLP

(57) ABSTRACT

A method and apparatus are provided for mixing highly viscous fluids to form a mixture. The mixture is created rapidly and has a high level of uniformity. The mixture is created by utilizing induced viscous fluid folding under the influence of an electric field. The electric field is introduced by connecting a nozzle dispensing the fluids in parallel to a voltage supply and grounding a collection plate located below the nozzle. When a certain voltage is applied the co-flow viscous fluids start to fold because the electric field exerts stress on the surface of the fluids, which results in changes of the geometry and dynamics of the viscous fluids. Control of the electric field provides great control over the mixture.

10 Claims, 4 Drawing Sheets

(52) U.S. Cl.
CPC ..... *B01F 2215/0427* (2013.01); *B01F 2215/0431* (2013.01); *B01F 2215/0445* (2013.01); *B01F 2215/0495* (2013.01)

(58) Field of Classification Search
CPC ..... B01F 2215/0431; B01F 2215/0445; B01F 2215/0495
See application file for complete search history.

(56) References Cited

FOREIGN PATENT DOCUMENTS

| | | |
|---|---|---|
| WO | WO 2005010147 A2 | 2/2005 |
| WO | WO 2005075062 A1 | 8/2005 |

OTHER PUBLICATIONS

R.K. Thakur, Ch. Vial K. D.P. Nigam, E.B. Nauman and G Djelve, "Static Mixers in the Process Industries—A Review," Trans. IChemE., Aug. 2003, vol. 81, pp. 787-826.
H.P. Grace-Chem. Eng., "Dispersion phenomena in high viscosity immiscible fluid systems and application of static mixers as dispersion devices in such systems," Chemical Engineering Communications, 1982, 14, pp. 225-277.
S. Wang, X. Huang, and C. Yang, "Mixing enhancement for high viscous fluids in a microfluidic chamber," Lab. Chip. 2011, 11, pp. 2081-2087.
W E Teo, S Ramakrishna, "A review on electrospinning design and nanofibre assemblies," Nanotechnology, 2006, 17, pp. R89-R106.
B. Jha, L. Cueto-Felgueroso, R. Juanes, "Fluid mixing from viscous fingering," Phys. Rev. Lett., 2011, 106:194502, 3 pages.

* cited by examiner

Without electric field

With electric field

0kV 6kV 7kV 8kV 9kV

METHOD AND APPARATUS FOR RAPID MIXING OF HIGHLY VISCOUS FLUIDS

CROSS-REFERENCE TO RELATED PATENT APPLICATIONS

This application is a U.S. National Phase Application under 35 U.S.C. § 371 of International Patent Application No. PCT/CN2015/080313, filed May 29, 2015, which is incorporated by reference in their entirety. The International Application was published on Dec. 8, 2016 as International Publication No. WO 2016/191949 A1 under PCT Article 21(2).

FIELD OF THE INVENTION

The present invention relates generally to a method and apparatus for efficiently and rapidly mixing two or more fluids that have large and different viscosities. More particularly, the present invention relies on electrifying viscous fluids and inducing them to fold vigorously.

BACKGROUND OF THE INVENTION

The mixing of two or more liquids is an operation that is typically done for the purpose of making the resultant mixture uniform. Such a mixing operation controls many chemical or industrial processes, such as chemical and biological reactions, as well as suspension formulation. The quality of the end product depends vitally on the efficiency and the thoroughness of the mixing process. Poor mixing can lead to inefficient or incomplete reaction between substances, resulting in end products with unsatisfying performance.

Mixing is usually efficient and rapid in turbulent flow with a high Reynolds number. However, for highly viscous fluids, especially in confined spaces, the flow is laminar with a low Reynolds number. Without turbulence mixing is mainly governed by molecular diffusion. The slow diffusion within viscous fluid leads to an extremely slow mixing or almost no evident mixing. This presents a major challenge when rapid mixing between fluids with large viscosities is a vital process.

It is always difficult to mix two viscous fluids, for example, silicone oils. Conventionally, viscous fluids are mixed by agitation of the fluids with mechanical impellers. However, this type of mixing only works at macroscopic levels and only the fluids around the impellers are mixed. The energy consumption is high and increases sharply with increased viscosity of the fluids. Moreover, heat transfer during mixing is generally poor in viscous fluids, which causes inconvenience during the agitating process. See, R. K. Thakur, Ch. Vial, K. D. P. Nigam, E. B. Nauman and G. Djelveh, *Trans. IChemE.,* 81, 787 (2003).

Mixing can be slightly enhanced with piezoelectric disks in microfluidic channels; but, only in confined areas where the Reynolds number is on the scale of $10^{-2}$. However, the highest viscosity that can be managed is 44.75 mPa·s. See, S. Wang, X. Huang, and C. Yang, *Lab. Chip.,* 11, 2081 (2011). Mixing can also be enhanced by using a viscous fingering effect. This fingering effect maximizes the interfacial area between viscous fluids and minimizes the mixing time. However, it only works where there is a viscosity contrast between fluids and this contrast must be within an optimum range. See, B. Jha, L. Cueto-Felgueroso, R. Juanes, *Phys. Rev. Lett.,* 106, 194502 (2011)

Many methods have been proposed to enhance mixing between different liquids in low Reynolds number flow patterns. For instance, complex and curved channels have been designed to generate chaotic advection to promote mixing passively. Alternatively, active approaches such as ultrasonic micromixers, acoustic oscillating bubbles and additional pumps have been introduced. These active mixers impose chaotic mixing by stretching and folding the fluid surfaces.

However, the viscosity that can be handled with these methods is limited within a few tens of mPa·s. High viscosity associated large resistance for fluid motion poses crucial limitations for the above-mentioned methods. Moreover, for passive approaches, the principle is straight-forward; but, it involves complex channel fabrication, lacks flexibility and is usually associated with dead volume trapped in channels. For active approaches which typically involve foreign objects, additional steps to remove these objects add complexity to the operation. More importantly, fluids near the mixer get more homogenous than fluids far away from the mixer.

It is also known in the art that solidified nanofibers can be made by a method known as electrospinning. Electrospinning uses an electric charge applied between an outlet nozzle of a container for a fluid and a conducting collector plate in order to draw a very fine (typically on the micro or nano scale) fiber from the fluid. The fiber can fold like an elastic rope when compressed. However, typical fluids used in electrospinning are often conductive and not viscous. Also, either a single fluid or a pre-mixed fluid is used. See, W E Teo, S Ramakrishna, *Nanotechnology* 17, R89 (2006)

It would be advantageous to have a method and apparatus that could rapidly and effectively mix very viscous fluids, without the draw backs of the prior art.

SUMMARY OF THE INVENTION

The present invention relates to a generic method and apparatus for rapidly and efficiently mixing fluids that have very large viscosities in a controlled fashion, and producing a uniform result.

The present invention is based on using electric force to induce viscous fluids to fold vigorously. The fast folding of the viscous fluids leads to a fast stretching and folding of the fluid interfaces, which reduces the mixture to a uniform state rapidly. It can be applied to mix rapidly two or more fluids with large viscosities, without the necessity to use a foreign mixer that must be disposed of later. The viscous fluids are mixed sufficiently and efficiently with no associated dead volumes. Moreover, the energy consumed does not increase with the increase of fluid viscosity.

The method of this invention can be applied to mix multiple fluids with large but different viscosities, provided the mean viscosity by volume averaging is sufficiently large.

In an exemplary embodiment the two or more fluids with large viscosities are introduced into the top of a common chamber that is suspended above a conducting collection plate. The fluids are allowed to pass or co-flow through the chamber and exit through a conducting nozzle at the bottom of the chamber, which nozzle is at a distance above the plate. A high electrical voltage is applied between the nozzle and the plate by connecting the positive end of a power supply to the nozzle or injection device, and the negative end to the collection plate. The voltage creates an electric field that causes the fluids to fold into one another as they pass from the nozzle to the plate. Further folding occurs as the fluids collect on the plate. In effect, the applied electric field exerts electrical stress on the surfaces of the viscous fluids, changing their geometry and dynamics.

By applying different high voltages, different mixing results can be obtained. In particular, as the voltage increases the mixing of the fluids increases during the same period of time.

The mixture made from the mixing of different viscous fluids by the present invention, in which electric force induces the viscous fluids to fold vigorously, is uniform and can be tuned by tuning the electric force. The electric force can be adjusted not only by changing the applied voltage, but also the distance between the electrodes.

The mixing efficiency between viscous fluids is controlled by the folding frequency and the diameter of the nozzle or jet through which both viscous fluids flow. Both the folding frequency and jet diameter can be tuned by the electric force or field strength efficiently.

Preferred examples of fluids that can be mixed with the present invention are fluids with large viscosities (silicone oils with viscosity I 2 Pa·s; silicone oil and n-butanol mixture; polydimethylsiloxane with viscosity I 3.5 Pa·s; lecithin from soy bean; polyglycerol polyricinoleate; commercial epoxy resins). Preferred examples of viscous fluids to demonstrate the effective mixing are polydimethylsiloxane and polydimethylsiloxane with an oil-soluble fluorescent dye, Oil Red O. Preferred examples of viscous fluids to demonstrate that the electric force controls the folding frequency and jet diameters are lecithin from soy bean, polyglycerol polyricinoleate, and mixtures of silicone oil and n-butanol with different volume ratios. Preferred examples of viscous fluids to demonstrate that the effectiveness of the applied electric force include mixtures of silicone oil and n-butanol with different volume ratios. Preferred examples of viscous fluids to demonstrate the effective mixing and the performance of the mixture are commercial epoxy resins with two parts that can react with each other.

BRIEF DESCRIPTION OF THE DRAWINGS

The present invention can be more fully understood by the following detailed description of the preferred embodiments, with reference made to the accompanying drawings, wherein.

DETAILED DESCRIPTION OF EXEMPLARY EMBODIMENTS OF THE INVENTION

Figure 1A:
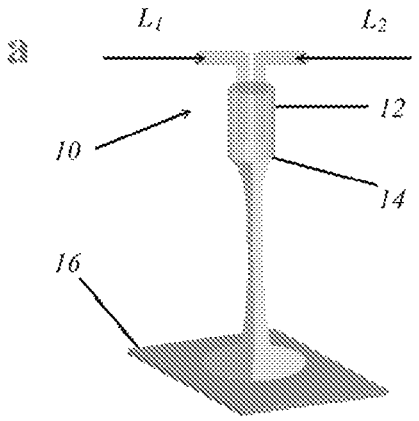
FIG. 1 is an illustration of a device for practicing the method of the present invention.
Figure 1B:
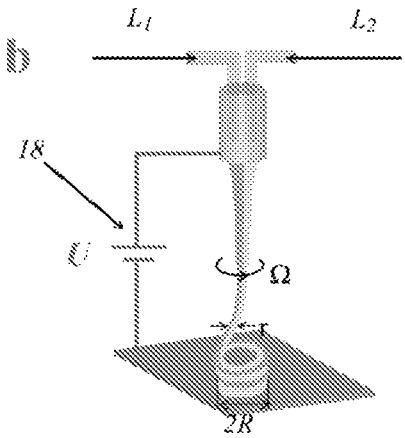

FIG. 1 shows a simplified setup of apparatus for practicing the present invention. In FIG. 1 two viscous fluids $L_1$, $L_2$ are injected in parallel by syringe pumps (not shown) through separate entrances to a Y-shaped connector 10. The exit of the connector leads into a cylinder 12. The fluids essentially pass through the cylinder without mixing to a metal nozzle 14. A metal collection plate 16 is placed underneath the metal nozzle and the fluids exiting the nozzle collects on the plate 16. As shown in FIG. 1*a*, when no electric field is applied, the fluids remain unmixed. In fact, if the two oils are put together for a number of hours, they remain unmixed. However, as shown in FIG. 1*b*, when an electric field is provided by source 18, the co-flowed viscous fluids are caused to fold and mix.

The two viscous fluids are, for example, polydimethylsiloxane and polydimethylsiloxane with an oil-soluble dye, Oil Red O to provide contrast and illustrate the mixing. The nozzle 14, which may be all metal or have a metal portion or band, may have an inner and outer diameter of 1.4 mm and 1.84 mm, respectively. The distance between the nozzle 14 and the plate is typically 1 cm-2 cm. The metal nozzle is connected to the positive end of the high voltage supply 18, and the metal plate is connected to the negative end of the power supply. The voltage is tuned in a range of 0-12 kV (FIG. 1). The two viscous fluids are injected with the same flow rate in a range of about 5-80 ml/h.

The size of the nozzle 14 can be varied from 20 μm to tens of millimeters. The nozzle can be fabricated using metal tubes or glass capillaries with metal bands depending on the applications. The viscous fluids $L_1$ and $L_2$ are injected into the nozzle, which has a diameter $d_{nozzle}$, using syringe pumps (Longer Pump) with constant flow rates of $Q_1$ and $Q_2$. Due to the high viscosity and the relatively small scale, the injected fluids flow in parallel with distinctive border lines between each other, i.e. "co-flow." See the light and dark grey materials in FIG. 1*a*. The electric field generated is in the same direction as the fluid flow direction. The distance between the nozzle and collection plate is h, and the potential difference is U. Thus, the electric field intensity is estimated as follows:

$$E=U/h$$

Figure 2:
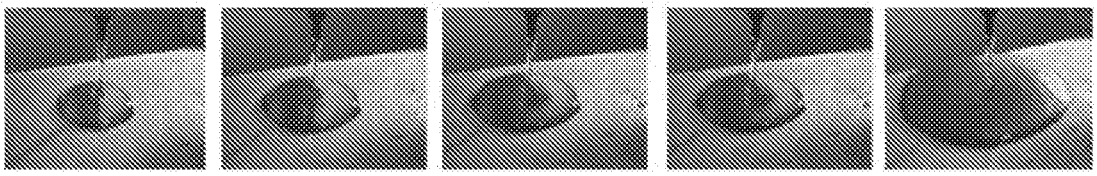
FIG. 2 shows a series of images in which the co-flow of silicone oils are induced to fold as the voltage increases.
Figure 5:
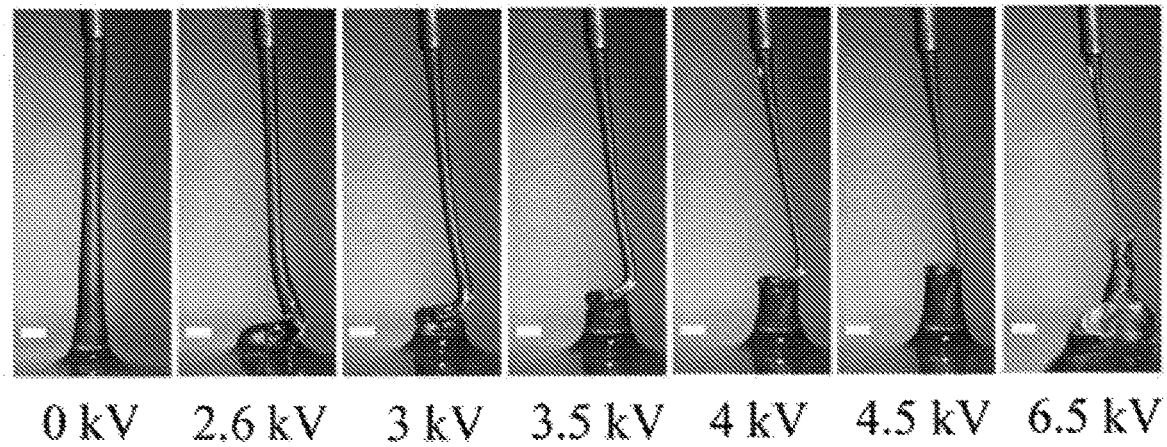
FIG. 5 is a series of photographs showing that as the electric field intensity increases, the diameter of the jet of fluid gets thinner and it folds faster.

As the electric field is turned on and increased to a threshold value, the injected viscous fluid becomes thinner, starts to fold/coil vigorously and falls onto the grounded plate 16. The electrically induced folding of the viscous fluids can be visualized and recorded by a high speed camera (Phantom V 9.1) with a lens (Nikon) with fixed time intervals as shown in FIG. 2 and FIG. 5.

The fluids employed in all experiments have a viscosity higher than 1.5 Pa·s, including epoxy resins, polydimethylsiloxane oil, and silicone oil with different viscosities. High viscous fluids up to 16 Pa·s have been tested without any clogging problem. In order to visualize the mixing quality, an oil-soluble dye, Neil Red, may be added in silicone oil as one liquid phase. The other liquid phase contains no dye. This shows up as the light and dark grey fluids in FIG. 1. The two viscous fluids, with and without dye respectively, are injected into the nozzle, and flow in parallel until they fall onto the collection plate. With no electric field, a distinctive border line remains between the transparent and dyed regions, both for the falling jet and the deposition on the plate. This suggests no evident mixing between fluids during the time of observation when no electric field is present.

With an applied electric field of 4 kV/cm, the viscous jet is set to fold/coil vigorously, and the coils spread onto the plate with no distinctive regions. FIG. 1*b*. The result shows that the application of an electric field increases the mixing efficiency significantly. FIG. 2 shows a series of images in which the co-flow of silicone oils (light and dark) are induced to fold as the voltage increases from 0 kV to 9 kV, and the color of the subsequent depositions of the viscous fluids changes from dark/light to dark, which indicates mixing between these two fluids.

Figure 3:
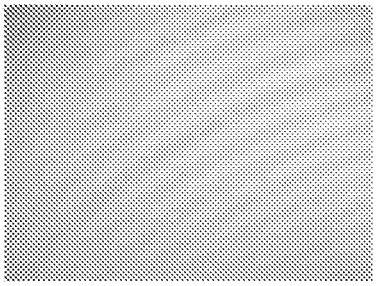
FIG. 3 shows a growth ring pattern for the mixed fluids.

The failure to mix without an electric field and the mixing with it can also be confirmed by a fluorescent image acquired by replacing the dye Oil Red with a fluorescent dye. In such an image the black region represents completely transparent polydimethylsiloxane and the white region represents dyed polydimethylsiloxane. The fluorescent image of FIG. 3 shows a growth ring pattern in which the grayscale indicates dye concentration. The rings are an indication of the mixing.

Figure 4A:
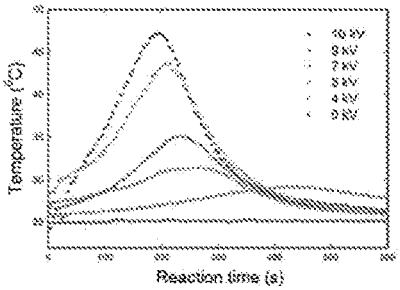
FIG. 4*a* is a plot of temperature against time under different applied voltages.
Figure 4B:
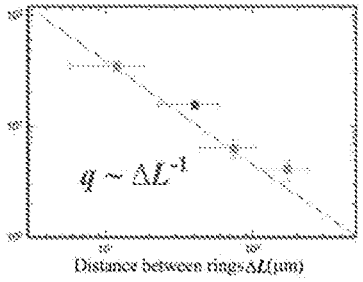
FIG. 4*b* is a log-log plot of the generated heat flux q during epoxy reaction as a function of the distance between the rings ΔL.
Figure 6A:
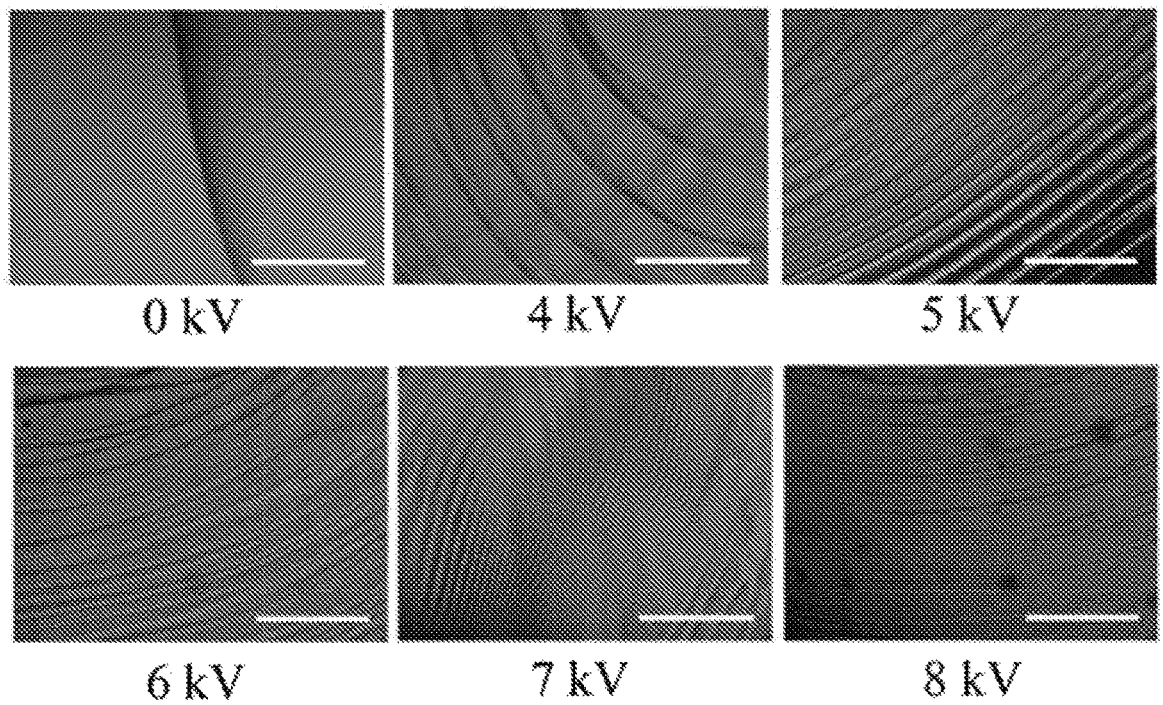
FIG. 6*a* is a series of photographs showing the thickness between the growth ring patterns of the mixed fluids for different electric fields.
Figure 6B:
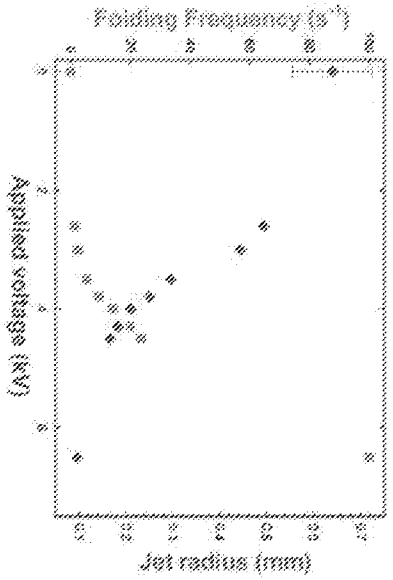
FIG. 6*b* is a graph showing an increase in folding frequency and a decrease in jet radius with increased electric fields.

Without the electric field, the two epoxy resins are not well-mixed and the reaction is incomplete. As a result, the poorly mixed epoxy cannot solidify. This can be demonstrated by showing that the mixture is not able to stick a metal rod onto the plate. However, the resultant fluid mixture obtained with an electric field and collected on the plate cures into a solid. Moreover, as the electric field intensity increases, there is a faster temperature rise. This indicates that the high applied voltage leads to fast initiation of the reaction See FIG. 4*a*, which is a plot of temperature against time under different applied voltages. In order to arrive at the plot of FIG. 4*a*, the temperature change of the deposited epoxy puddle is monitored for 10 minutes. The rise in temperature indicates the initiation of the reaction while the drop in temperature is due to heat dissipation to the ambient environment. Meanwhile the higher electric field intensity also promotes a thorough reaction, thus a higher temperature is reached. In particular, the higher the voltage the faster the temperature is reached. This implies that more heat is generated with higher applied electric field intensity. FIG. 4*b* is a log-log plot of the generated heat flux q during epoxy reaction as a function of the distance between the rings, which can be controlled by the electric force (FIG. 6*b*). As can be seen in FIG. 4*b*, the heat flux increases linearly with the reciprocal of the diffusion distance.

Figure 4C:
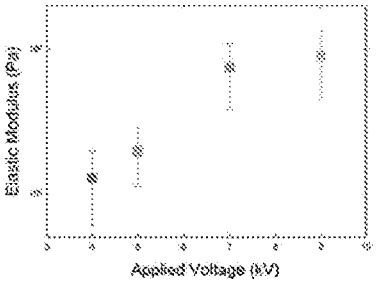
FIG. 4*c* is a plot of the elastic modulus of a mixed and reacted epoxy as a function of applied voltages.

In order to further demonstrate that the high applied voltage promotes a thorough reaction, the degree of solidification after the resins are mixed and reacted for 10 minutes is evaluated to ensure complete reaction. This evaluation shows that the mixture is stiffer with higher applied voltage, as indicated by an increase of elastic modulus of the mixture with applied voltages. See FIG. 4*c*, which is a plot of the elastic modulus of the mixed and reacted epoxy as a function of applied voltages. These results together demonstrate that the present invention is an effective, robust and rapid method for mixing highly viscous liquids in a controlled manner.

As shown in FIG. 5, as the applied electric force increases, the folding frequency increases and the diameter (radius) of the jet decreases. For example, near the threshold value of the on-set of coiling, the fluid coils at a low frequency and the diameter of the fluid jet is on the same scale as the nozzle size. As the electric field intensity E increases, the jet of fluid gets thinner and it folds faster with such high frequency that the fluid stacks into a column on the grounded plate. In FIG. 5 the fluid is lecithin from soy bean. The fluid column then spreads onto the plate to form a growth ring pattern (FIG. 3).

Figure 6C:
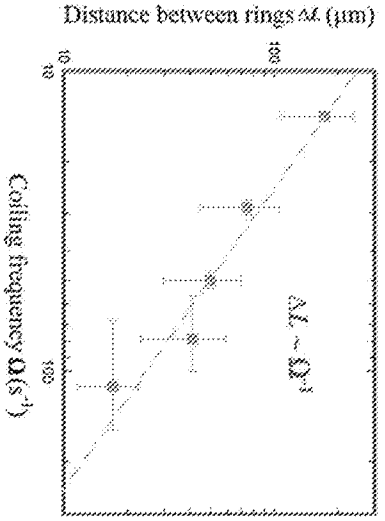
FIG. 6*c* is a log-log plot of the distance between the rings as a function of the folding frequency.

With low intensity, the growth ring pattern can be observed with naked eye; while with high intensity, the ring pattern can only be observed with high magnification under a microscope. (FIG. 6*a*) The thickness between the growth ring patterns is the characteristic diffusion distance L for subsequent diffusion. The diffusion time depends strongly on the diffusion distance L and the diffusion coefficient D of the fluid molecules. As shown in FIG. 6*b*, increasing the field increases the folding frequency and decreases the jet radius (diameter). FIG. 6*c* shows a decrease in the distance between the rings with increasing folding frequency. The frequency increase causes the characteristic diffusion distance to decrease, which promotes rapid and efficient mixing (FIG. 6*c*). Moreover, this characteristic diffusion distance can be controlled by controlling the folding frequency to achieve desired length-scales for different chemical reaction rates. These results show that the mixing results can be controlled by controlling electric force.

Figure 7A:
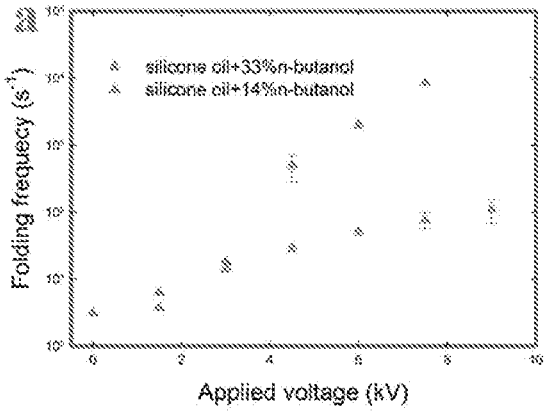
FIGS. 7*a* and 7*b* are graphs of the folding frequency and jet diameters, respectively, at different applied voltages and for fluids with two different viscosities.
Figure 7B:
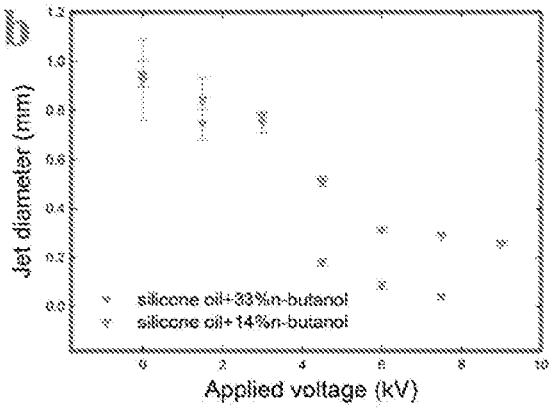

The electric force is larger for fluids with higher dielectric constant than with a lower dielectric constant, under the same electric field intensity. As a result, with the increase of electric field intensity, the increase in folding frequency, as well as the decrease in jet diameter, is more pronounced with fluids with high dielectric constant See FIGS. 7*a* and 7*b*. In those figures the fluids are mixtures of silicone oil and n-butanol. Their viscosities are formulated to be the same. The dielectric constants of silicone oil and n-butanol are 2 and 17.8 respectively.

Thus, sufficient mixing is easily achieved for fluids with high dielectric constant, since the applied electric force is easily sufficient to produce a fast folding frequency. However, for low dielectric constant fluids, to reach the same folding frequency, a much stronger electric field E needs to be applied.

While the invention has been particularly shown and described with reference to preferred embodiments thereof, it will be understood by those skilled in the art that various changes in form and details may be made therein without departing from the spirit and scope of the invention. Additionally, many modifications may be made to adapt a particular situation to the teachings of claimed subject matter without departing from the central concept described herein. Therefore, it is intended that claimed subject matter not be limited to the particular examples disclosed, but that such claimed subject matter may also include all implementations falling within the scope of the appended claims, and equivalents thereof.

What we claimed is:

1. A method for producing a mixture of two fluids of large viscosities with a high level of uniformity, comprising the steps of:

causing the two fluids to co-flow in parallel with each other;

passing the two parallel co-flow fluids through a nozzle with a conductor portion;

providing a collection plate with a conductor portion for receiving the co-flowing fluids from the nozzle; and inducing an electric field in the co-flowing fluids that is in the direction of their flow by applying an electrical voltage between the conductor portion of the nozzle and the conductor of the collection plate, whereby viscous fluid folding is induced in the fluids to mix them.

2. The method for producing a mixture as in claim 1 wherein the two fluids have different viscosities.

3. The method for producing a mixture as in claim 1 wherein a frequency of folding is controlled by controlling amplitude of the induced electrical voltage.

4. The method for producing a mixture as in claim 1 wherein a frequency of folding is controlled by controlling a distance between the nozzle and collection plate.

5. The method for producing a mixture as in claim 1 wherein an intensity of the electrical field is in the range of 0 to 14 kV/cm.

6. The method for producing a mixture as in claim 1 wherein the nozzle has an inner diameter in the range of 40 micrometers to 2.0 mm.

7. The method for producing a mixture as in claim 1 wherein a flow rate of the two fluids is in the range of 5 to 80 ml/h.

8. The apparatus for mixing two fluids of large viscosities as in claim 1 wherein the viscosity of at least one of the fluids is at least 1.2 Pa·s.

9. The apparatus for mixing two fluids of large viscosities as in claim 8 wherein the viscosity of the at least one of the fluids is up to 16 Pa·s.

10. The apparatus for mixing two fluids of large viscosities as in claim 1 wherein the two fluids are caused to co-flow in parallel with each other through a cylinder.

* * * * *